US006652292B2

(12) United States Patent
Pratt et al.

(10) Patent No.: US 6,652,292 B2
(45) Date of Patent: Nov. 25, 2003

(54) ELECTRICAL CONNECTOR ASSEMBLY INCORPORATING PRINTED CIRCUIT BOARD

(75) Inventors: Gregory R. Pratt, Naperville, IL (US); Harry N. Etters, Plainfield, IL (US); Paul Christopher Berg, Batavia, IL (US); Russell L. Mackowiak, Wheaton, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/080,731

(22) Filed: Feb. 22, 2002

(65) Prior Publication Data

US 2003/0162421 A1 Aug. 28, 2003

(51) Int. Cl.[7] ..... H01R 12/00
(52) U.S. Cl. ..... 439/76.1; 439/620
(58) Field of Search ..... 439/76.1, 941, 439/620

(56) References Cited

U.S. PATENT DOCUMENTS

| | | | | |
|---|---|---|---|---|
| 5,340,334 A | * | 8/1994 | Nguyen | 439/620 |
| 5,599,208 A | * | 2/1997 | Ward | 439/620 |
| 5,605,477 A | * | 2/1997 | Wu et al. | 439/620 |
| 5,626,494 A | * | 5/1997 | Belopolsky et al. | 439/620 |
| 5,639,264 A | * | 6/1997 | Belopolsky et al. | 439/620 |
| 6,413,119 B1 | * | 7/2002 | Gabrisko et al. | 439/620 |

* cited by examiner

*Primary Examiner*—Tulsidas Patel
(74) *Attorney, Agent, or Firm*—Stacey E. Caldwell

(57) ABSTRACT

An electrical connector assembly includes a first connector having a dielectric housing mounting a plurality of conductive terminals. A second connector includes a grounding housing. A double-sided printed circuit board is sandwiched between the first and second connectors. One side of the board has circuit means connected to the terminals of the first connector. A second side of the board has ground circuit means connected to the grounding housing of the second connector.

32 Claims, 4 Drawing Sheets

ELECTRICAL CONNECTOR ASSEMBLY INCORPORATING PRINTED CIRCUIT BOARD

FIELD OF THE INVENTION

This invention generally relates to the art of electrical connectors and, particularly, to an electrical connector assembly which includes a first connector mounted on a second connector having a grounding housing.

BACKGROUND OF THE INVENTION

Generally, electrical connector assemblies include a pair of connectors or connector components mated or mounted together for running circuits through a connector interface. Conductive terminals typically are mounted in dielectric housings of at least one of the connector components. Often, printed circuit boards are used for various purposes and are connected to the terminals. In some instances, grounding systems are used, including grounding shells or entire grounding housings.

One type of electrical connector assembly includes one or more first connectors, such as a header connector, mounted on a grounding housing or chassis which may be fabricated of die cast metal material, for instance. The header connector includes a dielectric housing mounting a plurality of terminal pins. The header connector is mounted to one side of the grounding housing. The terminal pins extend through the housing, electrically isolated therefrom, and into a printed circuit board on the opposite side of the housing. The printed circuit board has terminal circuit means and ground circuit means on a single side thereof facing the housing. The terminals are connected to the terminal circuit means on the printed circuit board, and the housing is engaged with the ground circuit means on the same side of the circuit board. Other electrical components, such as filter capacitors, may be carried on the printed circuit board and electrically coupled through the terminal circuit means to the terminal pins of the header connector. Finally, other components such as integrated circuit chips, ferrite blocks and an additional printed circuit board may be mounted on the grounding housing on the side thereof opposite the side to which the header connector(s) is mounted.

Various problems are encountered with electrical connector assemblies of the prior art as described above. One problem is by putting both the terminal circuit means and the ground circuit means on the same side of the printed circuit board on the opposite side of the grounding housing, the overall size of the circuit board is unduly large. This takes up considerable space or "real estate" on the grounding housing and limits the available area where other components, such as integrated circuit chips, might be mounted. In addition, the more dense the circuitry on the header connector (i.e., the number of terminal pins), the less area is available on the printed circuit board for the ground circuit means.

A major problem with such assemblies is that it is desirable to test the header connector circuitry prior to actual use, such as when filter capacitors are incorporated with the terminal pins of the header connector. With the connector assemblies of the prior art, the entire assembly of the header connector(s) and the grounding housing had to be tested together because the header connector was mounted on one side of the housing and the printed circuit board and capacitors were mounted on the opposite side of the housing. If the assembly failed the test procedure, the entire assembly had to be discarded, including the die cast housing which is rather expensive. It would be desirable to be able to test the header connector(s) by itself before it is mounted on the grounding housing. In fact, it often would be desirable to be able to test the header connector alone at one location before it is even assembled to the grounding housing at another location.

The present invention is directed to solving this myriad of problems in a connector assembly of the character described by incorporating the printed circuit board in the header connector, itself, whereby this self-contained subassembly can be subsequently mounted to the grounding housing, after testing the header connector and even before mounting the connector to the housing at a remote location. The invention also significantly reduces the size of the printed circuit board to thereby increase the available space on the grounding housing, such as for mounting integrated circuit chips or other electrical components.

SUMMARY OF THE INVENTION

An object, therefore, of the invention is to provide a new and improved electrical connector assembly of the character described.

In the exemplary embodiment of the invention, the connector assembly includes a first connector having a dielectric housing mounting a plurality of conductive terminals. A second connector includes a grounding housing. A double-sided printed circuit board is sandwiched between the first and second connectors. One side of the printed circuit board has circuit means connected to the terminals of the first connector. A second side of the printed circuit board has ground circuit means connected to the grounding housing of the second connector.

According to one aspect of the invention, the grounding housing of the second connector may be a die cast metal housing which includes a plurality of posts projecting through holes in the double-sided printed circuit board. The holes are plated-through holes, with the posts being connected to ground circuit means on both sides of the printed circuit board.

According to another aspect of the invention, the conductive terminals of the first connector comprise terminal pins extending through holes in the printed circuit board, with the pins being electrically isolated from the ground circuit means on the second side of the printed circuit board. The double-sided printed circuit board is mounted to the first connector by a press-fit of the board over the terminal pins. A plurality of capacitor chips may be coupled, through the circuit means on the one side of the printed circuit board, to at least some of the terminal pins.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
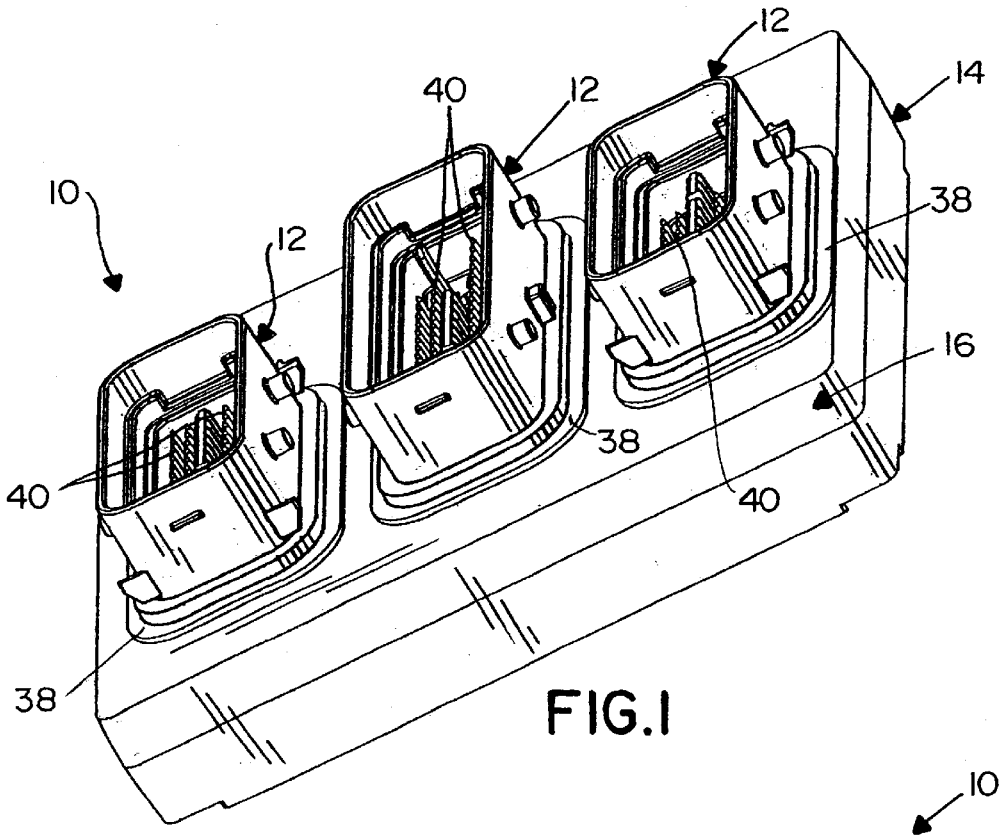
FIG. 1 is a top perspective view of an electrical connector assembly incorporating the concepts of the invention.

Referring to the drawings in greater detail, and first to FIGS. 1–4, the invention is embodied in an electrical connector assembly, generally designated 10, which includes one or more first connectors, generally designated 12, mounted on or mateable with a second connector, generally designated 14. In the illustrated embodiment, first connectors 12 are known as header connectors, and three header connectors are mounted on second connector 14 which includes a grounding housing, generally designated 16. The grounding housing may be a die cast metal component, or the housing may be of sheet metal or metal plated plastic material. A plurality of electrical components (not shown) are mounted on the bottom of grounding housing 16. As will be understood hereinafter, ample space or "real estate" is provided on the underside of the grounding housing between the header connectors to accommodate such electrical components.

Figure 3:
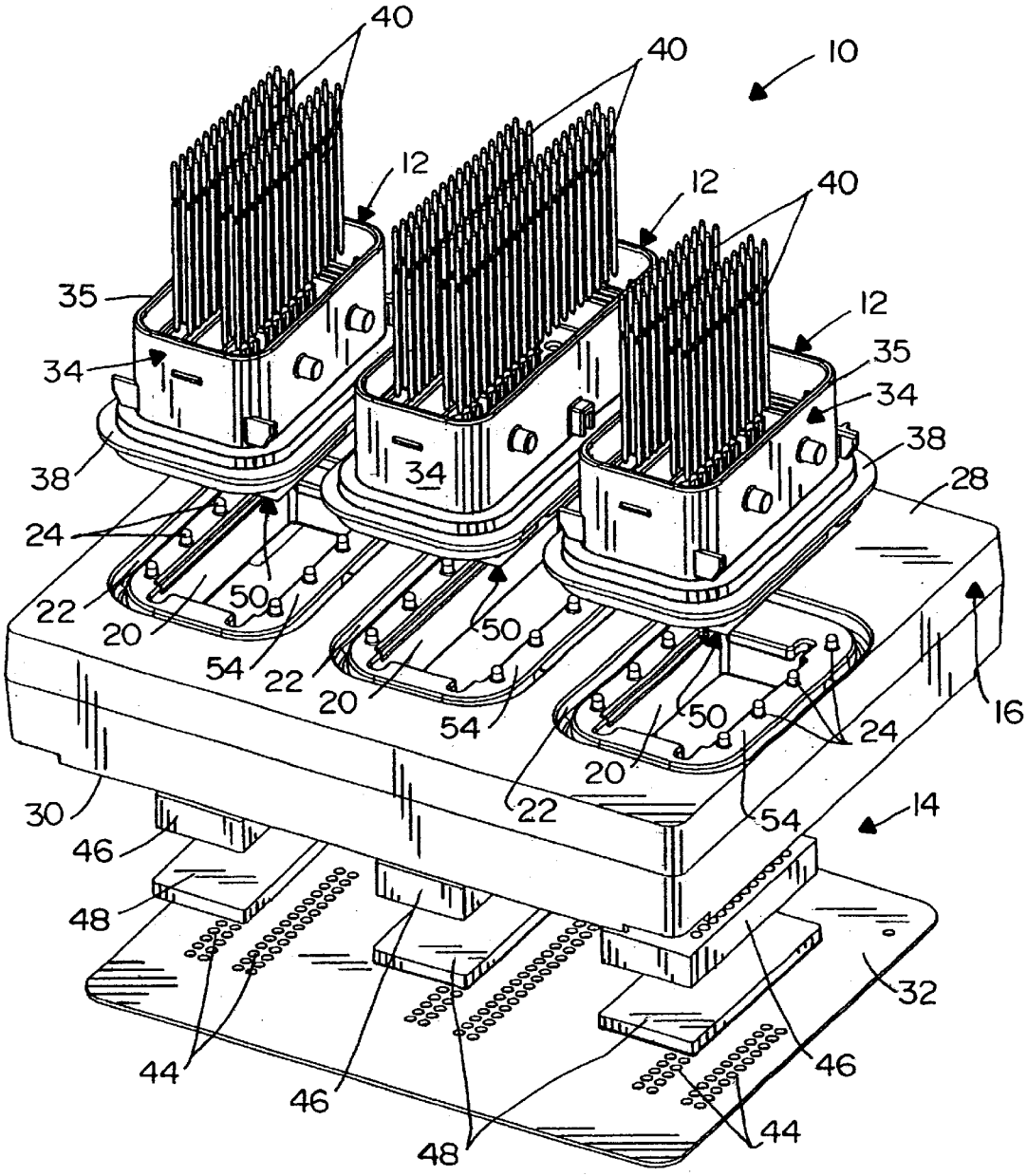
FIG. 3 is a top exploded perspective view of the assembly.

As best seen in FIG. 3, grounding housing 16 of second connector 14 of connector assembly 10 includes three through receptacles 20 aligned with header connectors 12. A groove 22 is cast in the housing surrounding each receptacle. A plurality of upstanding ground posts 24 also are disposed on two opposite sides of each receptacle. Basically, housing 16 includes a first or mounting face 28 having grooves 22 therein for mounting header connectors 12 thereto, and a second or bottom mounting face 30 (FIG. 4) to which a main printed circuit board 32 is mounted.

Each header connector 12 includes a dielectric housing, generally designated 34, which may be molded of plastic material or the like. The housing has a mating face or shroud 35. The housing has a peripheral depending flange 36 (FIG. 4) for mounting within a respective one of the grooves 22 in mounting face 28 of die cast housing 16. An outwardly projecting peripheral flange 38 abuts mounting face 28 of the die cast housing when the header connector is mounted to the housing.

Figure 2:
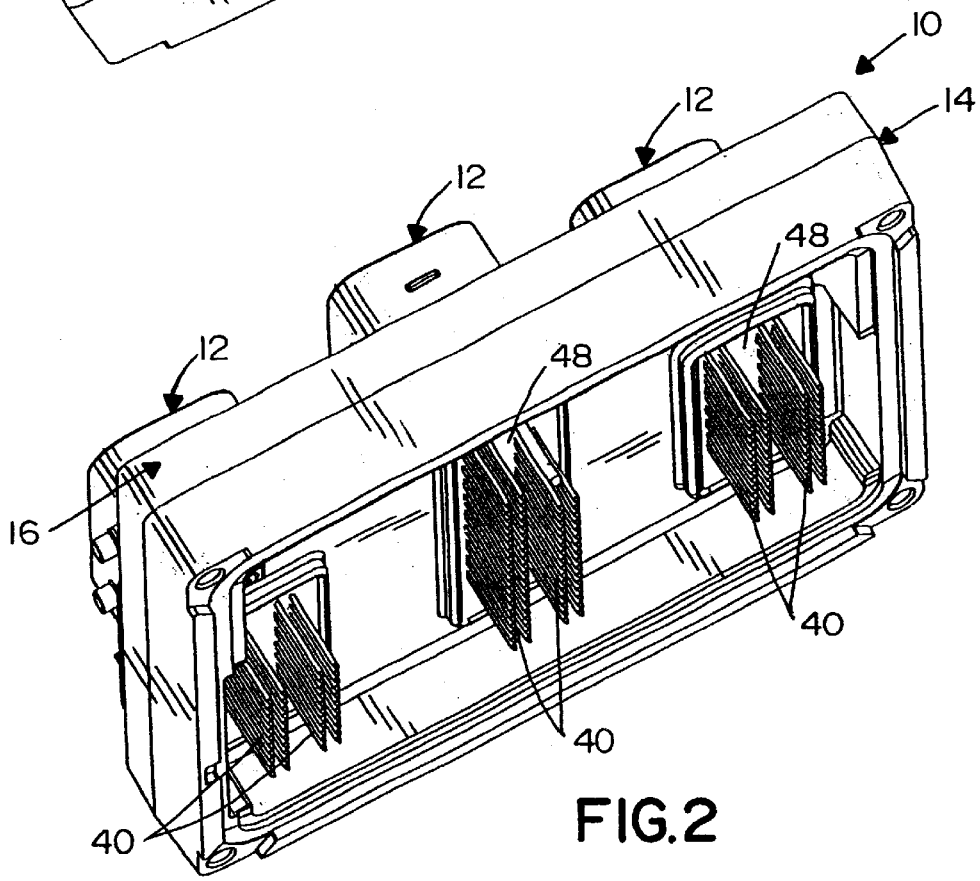
FIG. 2 is a bottom perspective view of the assembly.
Figure 4:
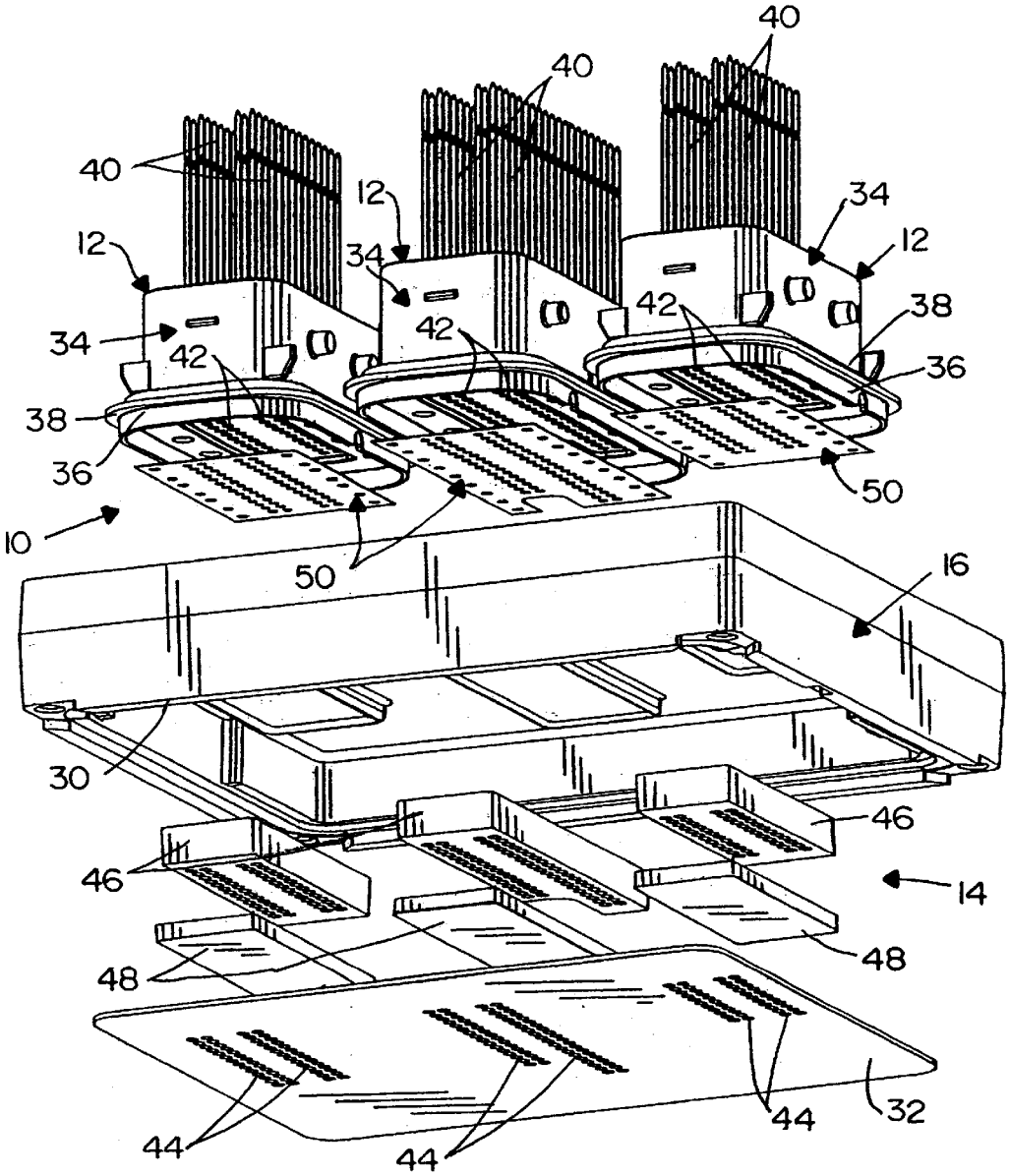
FIG. 4 is a bottom exploded perspective view of the assembly.
Figure 5:
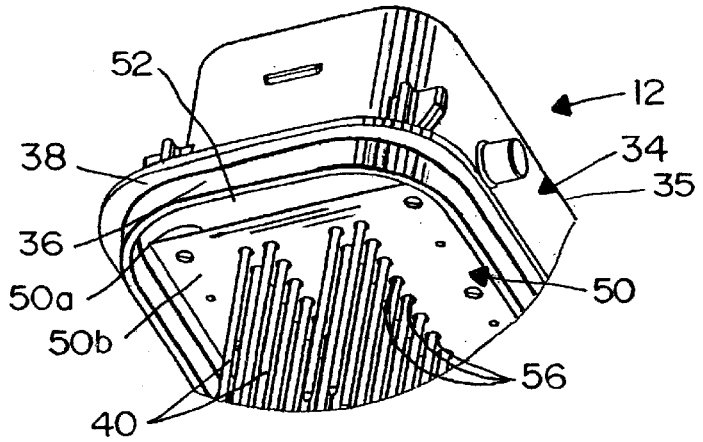
FIG. 5 is an enlarged, fragmented perspective view of the bottom of the header connector.

A plurality of terminal pins 40 are mounted in the dielectric housing 34 of each header connector 12. The pins are mounted in terminal-receiving passages 42 (FIG. 4) in the dielectric housing. FIGS. 3–5 show the terminal pins yet to be inserted into their respective dielectric housings of the header connectors. However, FIG. 2 shows the terminal pins extending completely through die cast grounding housing 16. FIG. 4 shows that main printed circuit board 32 has a plurality of holes 44 through which the lower distal ends of the terminal pins are inserted. It can be seen that the terminal pins are arranged in four generally parallel rows corresponding to four rows of terminal-receiving passages 42 in each dielectric housing 34 and corresponding rows of holes 44 in main printed circuit board 32. In essence, the terminal pins are connected to circuit traces on board 32 and/or in holes 44.

FIG. 4 shows that a ferrite block 46 is provided for each header connector 12 and through which terminal pins 40 of the respective header connector extend. Elements 48 represent an encapsulant which is used to seal and retain the ferrite blocks on the terminal pins. Actually, the ferrite blocks are mounted within receptacles 20 (FIG. 3) of die cast grounding housing 16, and the encapsulant is deposited in the bottoms of the receptacles to seal the terminal interface and to retain the ferrite blocks. The encapsulant may be deposited in liquid form and cured. Elements 48 somewhat schematically illustrate the cured form of the encapsulant.

According to the invention and as best seen in FIGS. 4 and 5, a double-sided printed circuit board, generally designated 50, is juxtaposed at a terminating face 52 (FIG. 5) of dielectric housing 34 of each header connector 12. In the preferred embodiment, the printed circuit boards are flexible circuit boards. As seen best in FIG. 5, terminal pins 40 extend through the double-sided printed circuit board. Generally, the top side 50*a* of the printed circuit board facing terminating face 52 of the dielectric housing has signal circuit means connected to the terminal pins. A second or bottom side 50*b* of the printed circuit board is engaged with grounding housing 16 at a platform 54 surrounding each receptacle 20. In the preferred embodiment, with printed circuit board 50 being a flexible printed circuit board, it is retained by a press-fit of all of terminal pins 40 within through holes 56 in the flexible circuit board.

Figure 6:
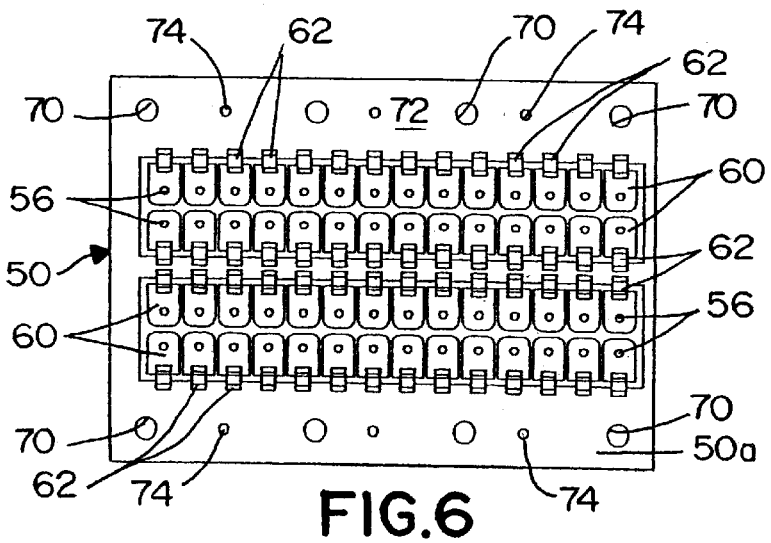
FIG. 6 is a plan view of one side of the double-sided printed circuit board.
Figure 7:
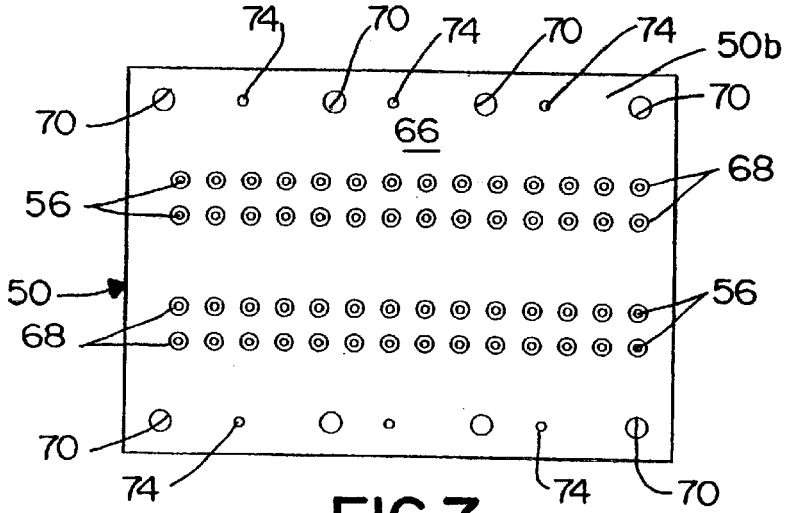
FIG. 7 is a plan view of the second side of the printed circuit board.

Referring to FIGS. 6 and 7 particularly in conjunction with FIG. 5, top side 50*a* of flexible circuit board 50 which faces a respective one of header connectors 12 is shown in FIG. 6. The bottom side 50*b* of the double-sided printed circuit board which engages grounding housing 16 is shown in FIG. 7. With that understanding, FIG. 6 shows a pattern of circuits 60 on top side 50*a* of the circuit board. It can be seen that holes 56 which receive pin terminals 40 extend through these circuits. When terminal pins 40 are inserted through holes 56 with a press fit, the conductive terminal pins mechanically and electrically engage the circuits around the holes in the flexible circuit board. Each circuit 60 is electrically coupled to an active electrical component such as a filter capacitor chip 62, thereby connecting the capacitor chips to terminal pins 40. Circuits 60 could be connected to a variety of other active components such as variable resistors or the like.

Referring next to FIG. 7, bottom side 50*b* of the double-sided printed circuit board has a large ground circuit plate area 66 substantially covering the bottom side of the board. The ground circuit or plating is removed in circular areas 68 around holes 56 which receive the terminal pins to electrically isolate the terminal pins from the ground circuit plating. Not only does ground circuit plating 66 engage one of the platform areas 54 (FIG. 3) about a respective receptacle 20, but upstanding ground posts 24 (FIG. 3) project through corresponding holes 70 in the circuit board. Finally, in order to increase the grounding capacity of flexible printed circuit board 50, an additional, peripheral ground circuit plating area 72 is provided on top side 50*a* of the circuit board. Top ground circuit plating 72 is electrically coupled to bottom circuit plating 66 by plated-through holes 74 which form electrical paths or "vias" between the top and bottom ground circuit plating. In actual practice, the conductive "plating" on opposite sides of the circuit board typically are conductive films deposited on a substrate.

From the foregoing, it can be understood that double-sided flexible printed circuit board 50 can be mounted on each header connector 12, with terminal pins 40 extending therethrough, as a subassembly shown in FIG. 5. This self-contained subassembly or unit can be tested before being assembled to a second connector such as connector 14 including die cast grounding housing 16. In fact, the self-contained header connectors can be tested at one location and assembled to the die cast grounding housing at another location. If a header connector fails the testing procedure, the failed header connector simply is discarded without having to discard the entire connector assembly 10, including die cast housing 16, as was done in the prior art. In addition, by providing a double-sided printed circuit board, the overall dimensions of the board are reduced, leaving more space or area on die cast grounding housing 16 for accommodating other electrical components. Even when high density circuitry is used, as shown in FIGS. 6 and 7, ample grounding capacity is afforded by the double-sided circuit board, including grounding plating on both sides of the board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a first connector including a dielectric housing mounting a plurality of conductive terminals;

a ferrite block having portions of the terminals extending therethrough;

a second connector including a grounding housing; and a double-sided printed circuit board sandwiched between the first and second connectors, one side of the printed circuit board having circuit means connected to the terminals of the first connector, and a second side of the printed circuit board having ground circuit means connected to the grounding housing of the second connector, a portion of the grounding housing being interposed between the printed circuit board and the ferrite block.

2. The electrical connector assembly of claim 1 wherein the grounding housing of said second connector comprises a die cast metal housing.

3. The electrical connector assembly of claim 1 wherein said grounding housing includes a plurality of posts projecting through holes in the double-sided printed circuit board.

4. The electrical connector assembly of claim 3, including additional holes in the double-sided printed circuit board which are plated-through holes whereby the posts are connected t ground circuit means on both sides of the printed circuit board.

5. The electrical connector assembly of claim 1 wherein the conductive terminals of said first connector comprise terminal pins extending through holes in the printed circuit board with the pins being electrically isolated from the ground circuit means on the second side of the printed circuit board.

6. The electrical connector assembly of claim 5, including a plurality of capacitor chips coupled through said circuit means on the one side of the printed circuit board to at least some of said terminal pins.

7. The electrical connector assembly of claim 5 wherein said double-sided printed circuit board is mounted to the first connector by a press-fit of the board over the terminal pins.

8. The electrical connector assembly of claim 1 wherein the conductive terminals of said first connector comprise terminal pins press-fit through holes in the printed circuit board in engagement with the circuit means on said one side of the printed circuit board.

9. The electrical connector assembly of claim 8 wherein said double-sided printed circuit board comprises a flat flexible circuit.

10. The electrical connector assembly of claim 8 wherein said grounding housing includes a plurality of posts press-fit through holes in the printed circuit board in engagement with the ground circuit means on said second side of the printed circuit board.

11. The electrical connector assembly of claim 10 wherein said double-sided printed circuit board comprises a flat flexible circuit.

12. The electrical connector assembly of claim 11 wherein the conductive terminals of said first connector comprise terminal pins press-fit through holes in the printed circuit board in engagement with the circuit means on said one side of the printed circuit board.

13. An electrical connector assembly; comprising:

an electrical connector including a dielectric housing having a mating face, a terminating face, and a plurality of terminal pins mounted in the housing and projecting at the terminating face thereof; and a double-sided printed circuit board disposed at the terminating face of the housing with the terminal pins extending therethrough, one side of the printed circuit board facing the terminating face of the housing having circuit means connected to the terminal pins, and a second side of the printed circuit board facing away from the terminating face of the housing having ground circuit means for connection to an appropriate ground component, the terminal pins being electrically isolated from said ground circuit means, the connector and the printed circuit board forming a unitary sub-assembly adapted to be positioned on a grounding structure.

14. The electrical connector of claim 13, including a plurality of capacitor chips coupled through said circuit means on the one side of the printed circuit board to at least some of said terminal pins.

15. The electrical connector of claim 13 wherein said double-sided printed circuit board is mounted at the terminating face of the housing by a press-fit of the board over the terminal pins.

16. The electrical connector of claim 15 wherein said double-sided printed circuit board comprises a flat flexible circuit.

17. An electrical connector assembly, comprising:

a first connector including a dielectric housing having a mating face and a terminating face, and a plurality of terminal pins mounted in the housing and extending between the mating face and the terminating face thereof;

a second connector including a grounding housing having a first mounting face opposing the terminating face of the dielectric housing of the first connector and a second mounting face adapted for mounting on a second printed circuit board; and a double-sided printed circuit board secured to the terminating face of the dielectric housing of the first connector with said terminal pins extending therethrough to form a unitary sub-assembly adapted to be positioned on the grounding housing, one side of the printed circuit board facing said terminating face and having circuit means connected to the terminal pins, and a second side of the printed circuit board having ground circuit means connected to the grounding housing of the second connector, the terminal pins being electrically isolated from said ground circuit means.

18. The electrical connector assembly of claim 17 wherein the grounding housing of said second connector comprises a die cast metal housing.

19. The electrical connector assembly of claim 17 wherein said grounding housing includes a plurality of posts projecting through holes in the double-sided printed circuit board.

20. The electrical connector assembly of claim 19, including additional holes in the double-sided printed circuit board which are plated-through holes whereby the posts are connected to ground circuit means on both sides of the printed circuit board.

21. The electrical connector assembly of claim 17, including a plurality of capacitor chips coupled through said circuit means on the one side of the printed circuit board to at least some of said terminal pins.

22. The electrical connector assembly of claim 17 wherein said double-sided printed circuit board is mounted to the first connector.

23. The electrical connector assembly of claim 22 wherein said double-sided printed circuit board is mounted to the first connector by a press-fit of the board over the terminal pins.

24. The electrical connector assembly of claim 17, including a ferrite block mounted at the second mounting face of said grounding housing and through which the terminal pins extend.

25. In combination with the connector assembly of claim 24, a second printed circuit board mounted over said ferrite block and connected to said terminal pins.

26. In combination with the connector assembly of claim 17, a second printed circuit board mounted at the second mounting face of said grounding housing and connected to said terminal pins.

27. In combination with the connector assembly of claim 17 wherein said double-sided printed circuit board comprises a flat flexible circuit.

28. In combination with the connector assembly of claim 27 wherein said terminal pins are press-fit through holes in the flexible circuit in engagement with the circuit means on said one side thereof.

29. An electrical connector assembly, comprising:

a dielectric housing having a mating face and a terminating face;

a plurality of terminal pins mounted on the housing and projecting at the terminating face thereof, a double-sided printed circuit board disposed at the terminating face of the housing, one side of the printed circuit board facing said terminating face having first circuit means, and a second side of the printed circuit board facing away from the terminating face of the housing having second circuit means for connection to an appropriate conductor means; and said terminal pins being press-fit into holes in the printed circuit board to secure the printed circuit board to the terminating face of the housing, the housing, terminal pins and printed circuit board thereby forming a unitary sub-assembly adapted for insertion into a cavity formed in a grounding member, the terminal pins being in engagement with the first circuit means on said one side of the printed circuit board and electrically isolated from the second circuit means on said second side of the printed circuit board.

30. The electrical connector of claim 29 wherein said double-sided printed circuit board comprises a flat flexible circuit.

31. The electrical connector of claim 29 wherein said conductor means comprise at least one post press-fit through a hole in the printed circuit board in engagement with the second circuit means on said second side of the printed circuit board.

32. The electrical connector of claim 31 wherein said double-sided printed circuit board comprises a flat flexible circuit.

* * * * *